United States Patent [19]

Massoudnia

[11] Patent Number: 5,035,335

[45] Date of Patent: Jul. 30, 1991

[54] STACKABLE AND NESTIBLE BACKS

[75] Inventor: Mohammad E. Massoudnia, Creve Coeur, Mo.

[73] Assignee: Gusdorf Corporation, St. Louis, Mo.

[21] Appl. No.: 582,788

[22] Filed: Sep. 13, 1990

Related U.S. Application Data

[63] Continuation of Ser. No. 351,581, May 15, 1989, abandoned.

[51] Int. Cl.[5] ..... A47B 47/00

[52] U.S. Cl. ..... 211/188; 211/181; 211/194

[58] Field of Search ..... 211/181, 188, 194, 37; 206/513

[56] References Cited

U.S. PATENT DOCUMENTS 4,444,320 4/1984 Chop ..... 211/194 X
4,444,321 4/1984 Chap ..... 211/134
4,754,885 7/1988 Rich .
4,805,785 2/1989 Pfeifer et al. ..... 211/188
4,821,885 4/1989 Ondrasik .

*Primary Examiner*—Alvin C. Chin-Shue
*Assistant Examiner*—Sarah A. Lechok
*Attorney, Agent, or Firm*—Gravely, Lieder & Woodruff

[57] ABSTRACT

A stackable and nestable rack construction formed essentially of wire stock so as to be capable of use in displaying articles on one or a stack of racks, or capable of being nested in groups of two or more to avoid using an unnecessary amount of space. Each rack is composed of similar end leg members that promote the reduction in number of parts or components, and the range of parts adopted to care for a wide variety of articles to be displayed or stored. These characteristics are unique to the provision of obtaining a low cost product.

8 Claims, 4 Drawing Sheets

FIG. 2.
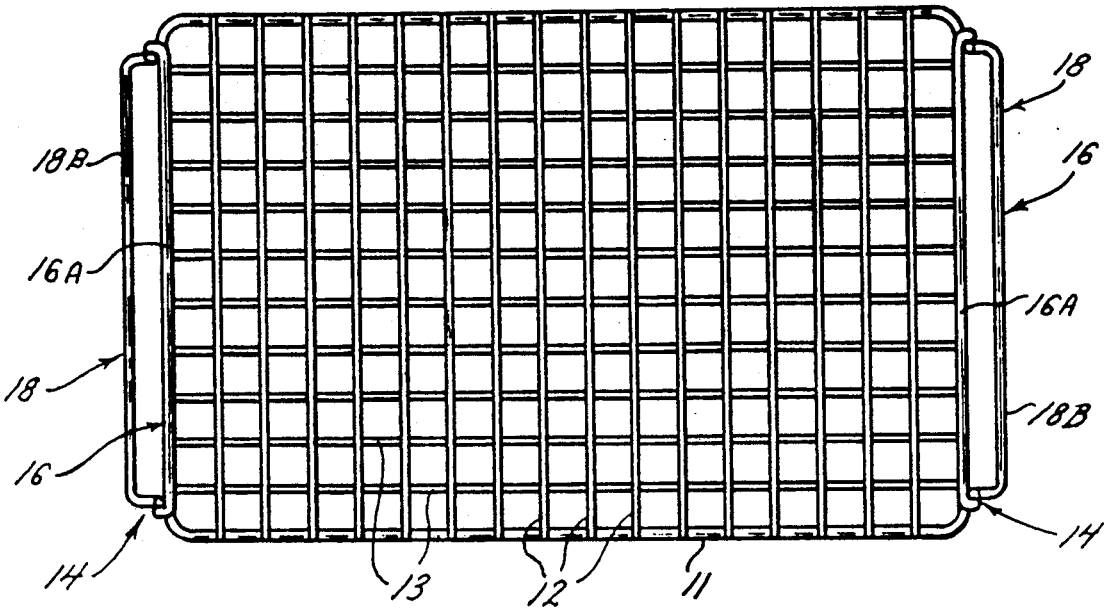
FIG. 1.
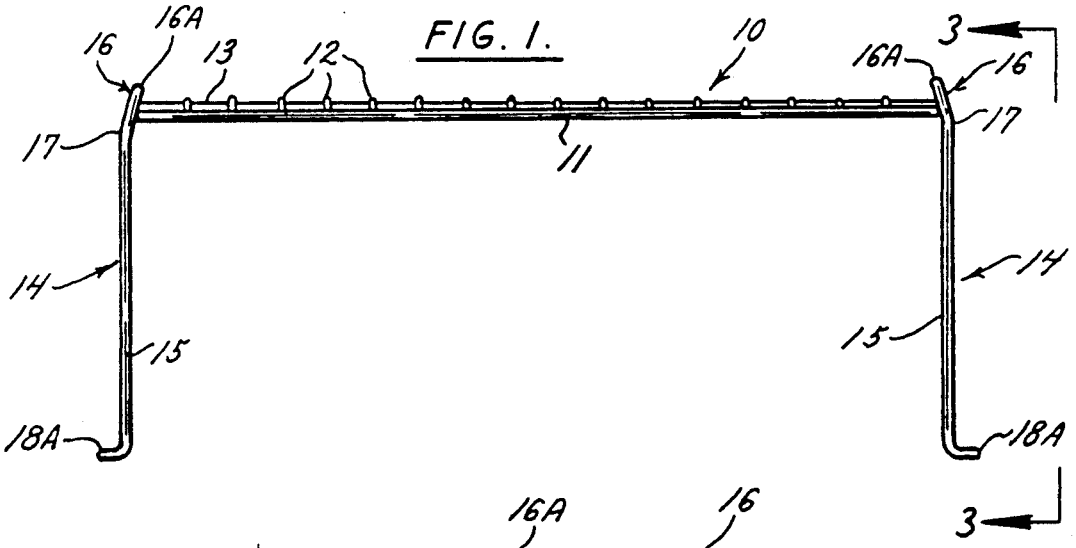
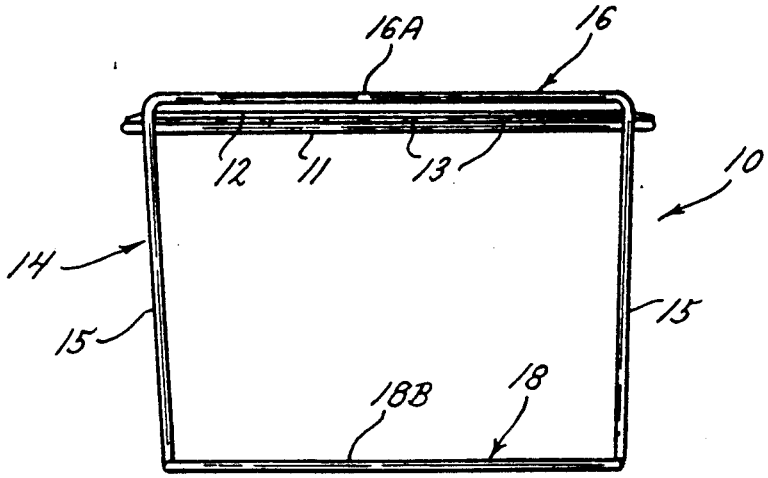
FIG. 3.

FIG. 5.
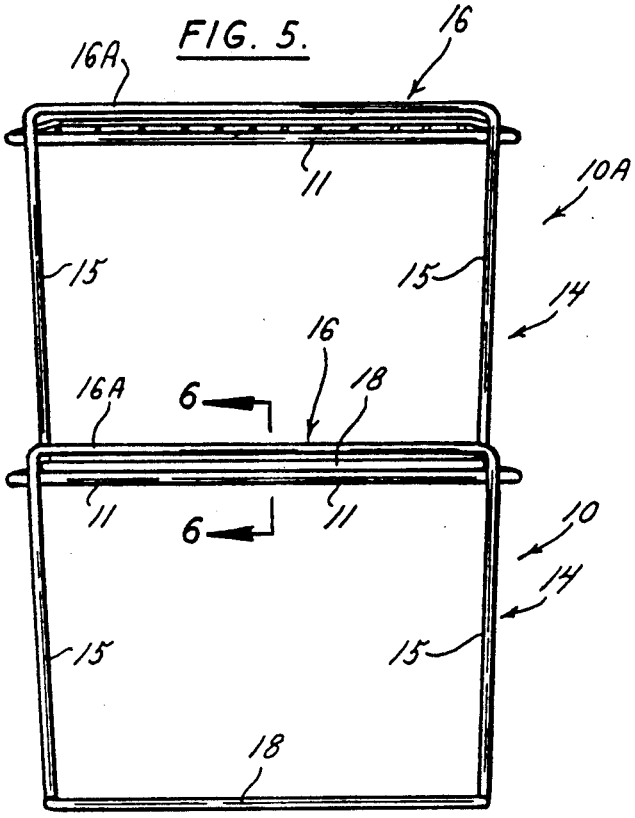
FIG. 6.
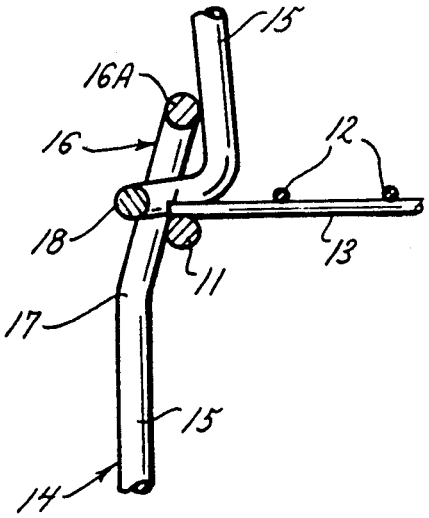
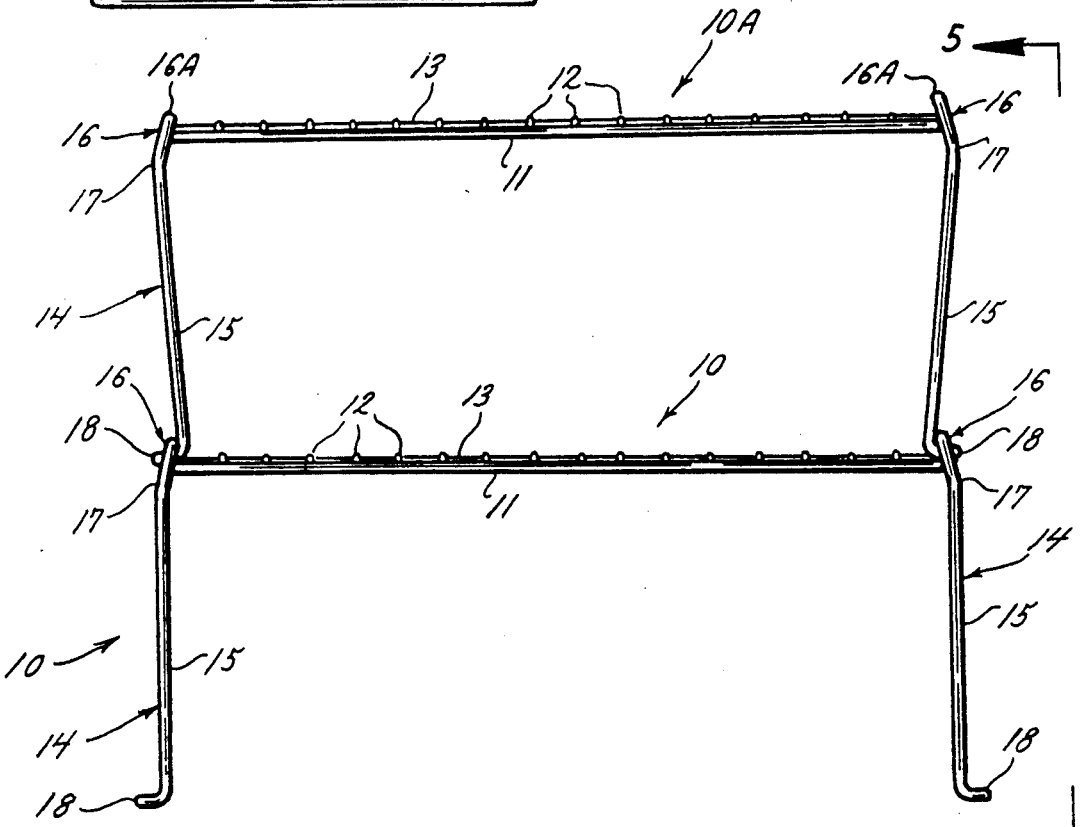
FIG. 4.

STACKABLE AND NESTIBLE BACKS

This is a continuation of copending application Ser. No. 07/351,581 filed on May 15, 1989 now abandoned.

BACKGROUND OF THE INVENTION

1. Field of the Invention

This invention is primarily concerned with a rack that is simple to fabricate and has the ability to fit in a stack of several such racks to provide means for article carriage, as well as to nest together for reduction of shipping bulk.

2. Description of the Prior Art

It is recognized that racks of various constructions have been made in the past in which some provisions for stacking the same in a vertical column is contemplated. Such constructions have rendered the racks expensive and usually make vertically spaced shelf surfaces not accessible. Examples of prior art are in U.S. Pat. Nos. 2,662,662 of Dec. 15, 1953; 3,149,748 of Sept. 22, 1964; 4,079,836 of Mar. 21, 1978; 4,361,234 of Nov. 30, 1982 and 4,697,713 of Oct. 6, 1987.

Other examples of the prior art are found in U.S. Pat. No. 3,333,722 of Aug. 1, 1967 and a more recent one 4,754,885 of July 5, 1988.

BRIEF DESCRIPTION OF THE INVENTION

The stackable rack of this invention is a simple and inexpensive product, made of metal wire stock, and constructed to provide for supporting articles which can be seen from any side or end margin. The rack is provided with legs at two opposite margins of the intervening article carrier, while the legs incorporate handles raise and slightly inwardly inclined toward the article carrier, while the legs extending below the carrier are freestanding and capable of being flexed or sprung inwardly toward each other so the feet on the legs of an upper rack can be engaged in the handles of a lower rack and retained so engaged, thereby forming a stack of two or more racks. The placing of one or more articles or objects on the carrier means increases security of engagement.

The invention is broadly directed to a rack having a carrier that is accessible from any margin, a pair of leg members connected to the carrier from opposite margins and formed with handle loop portions projecting above the shelf and depending leg portions freestanding below the shelf with outwardly turned foot loop elements shaped to engage in the handle loop portions of the next rack below the foot elements for interlocking two adjacent racks against being separated until the legs are released from the interlocking connections.

The objects of the present invention can be recognized in the structural configuration of the components which allows for low shipping costs by nesting the racks together or one inside another to conserve space, allows conservation of storage space, allows convenience of nesting to reduce a customer's package when buying several racks, allows stacking to improve in-store display of merchandise, and allows several stacked racks with merchandise in place to prevent separation when picked up by a top rack.

BRIEF DESCRIPTION OF THE DRAWINGS

The present invention is shown in a presently preferred construction wherein:

FIG. 1 is a front view of the rack showing certain characteristics thereof;

FIG. 2 is a top plan view of the rack;

FIG. 3 is an end view of the rack taken along line 3—3 in FIG. 1;

FIG. 4 is a front elevation view of a stack of two racks;

FIG. 5 is an end view of the stack seen in FIG. 4 along line 5—5;

FIG. 6 is an end view of the manner of nesting racks by aligning the end members of the top rack on the outside of the end members of the bottom rack with the end members laterally shifted;

DETAILED DESCRIPTION OF AN EMBODIMENT OF THE INVENTION

Figure 8:
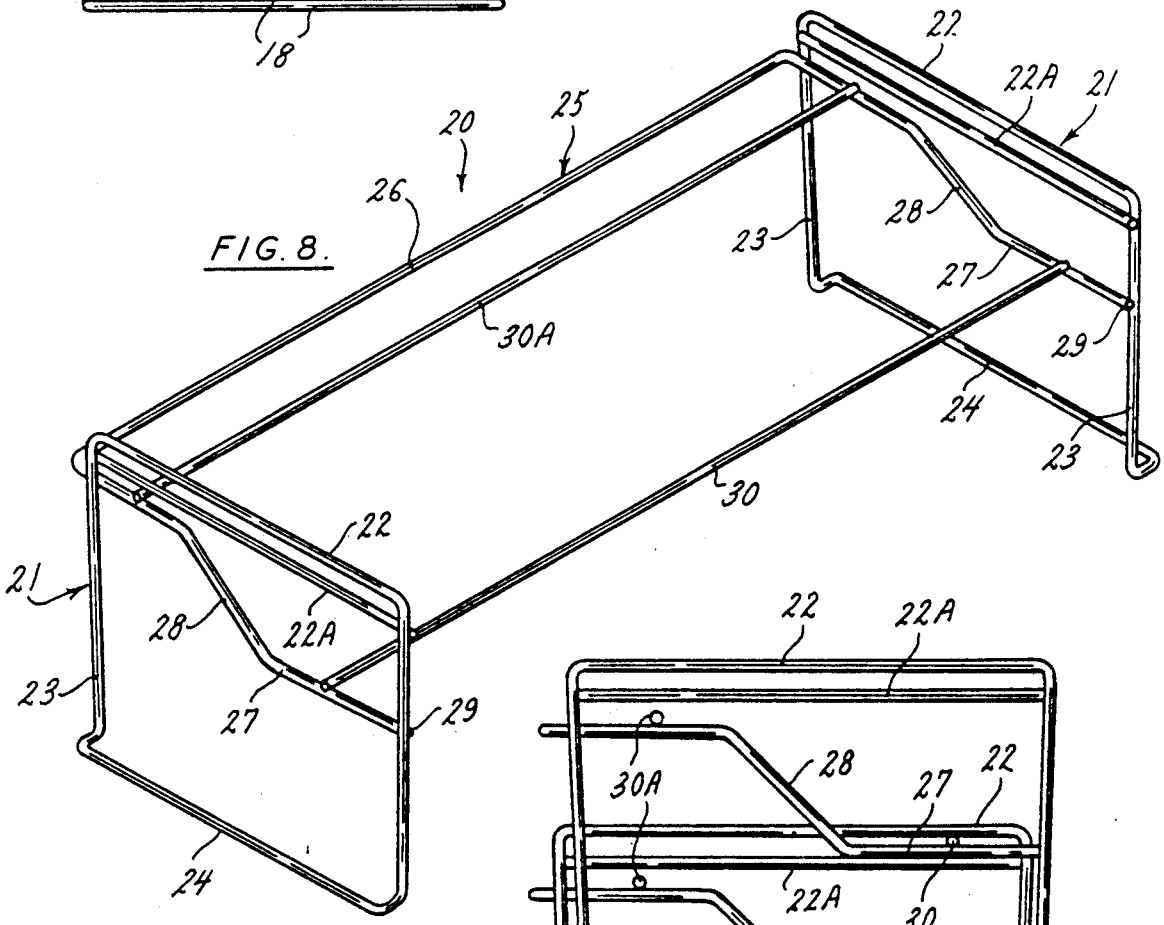
FIG. 8 is a perspective view of a modified rack arranged with a support for articles like shoes.

A presently preferred embodiment of the subject invention has been illustrated in relation to the form and purpose for the various parts, elements and assemblies seen in FIGS. 1 and 8 for example.

Figure 11:
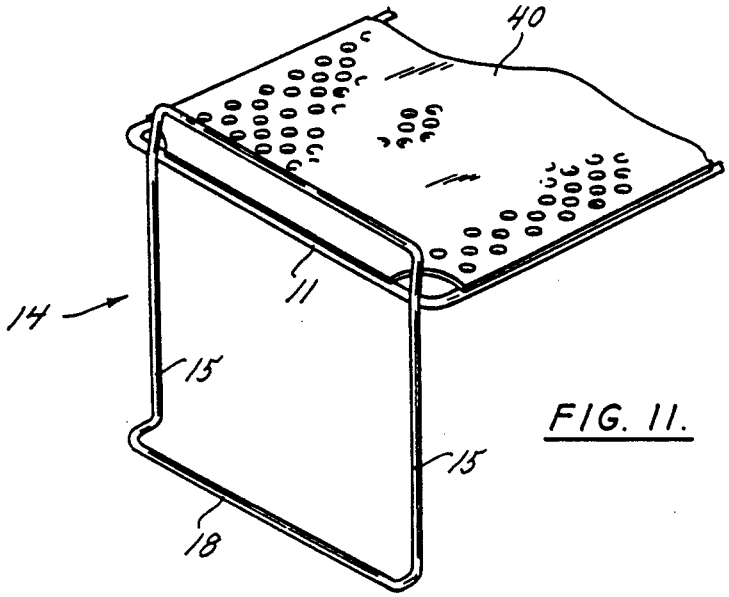
FIG. 11 is a fragmentary perspective view of a rack having a substantially rigid support surface.

First in relation to FIGS. 1 and 2, the rack is formed from wire parts to make up article carrier means in the form of a shelf 10 provides an object supporting surface and of rectangular shape in plan. That shelf 10 provides an object supporting surface and has a perimeter defining "wire" 11 of a desired gauge which has opposite ends held in spaced relation by end wires. These wires form the longitudinal side and transverse end margins of the shelf proper. The shelf 10 forms an object support surface which comprises longitudinal portions of the perimeter wire 11 offers support for a first series of spaced transversely directed wires 12 and a second series of longitudinally directed wires 13 arranged in a crossing grid to form the carrier in the form of a load supporting surface. Alternatively, a single series of spaced wires (either 12 or 13 but not both) may be used, or other arrangements of wires, as well as sheet material of wood, metal or plastic may form the carrier surface for a load, as dictated by the character of the load. An example is seen in FIG. 11.

The shelf 10 is supported by its perimeter wire 11 on a pair of leg members 14 secured by welding to the transverse portion of wire 11 and having the following unique characteristics. Each leg member is formed from a suitable gauge wire stock to have a handle loop 16 defined by a horizontal portion 16A ending in depending legs 15 from its opposite ends The legs 15 are slightly bent at an elbow 17, which elbow occurs at a short distance below the marginal perimeter wire 11, while the horizontal portion of the handle loop 16A is angularly directed over the underlying transverse perimeter wire 11. Each of the leg members 14 have the vertical legs 15 thereof inwardly tapered (see FIG. 3) so the bottom foot loop 18 is shorter, as measured between legs 15, than the handle loop 16A. Each foot loop 18 is turned outwardly or oppositely to handle loop 16 at substantially a ninety degree angle (more or less) to provide support when the carrier shelf 10 and leg elements 15 function as a rack. An important function of the foot loops 18 is obtained when two or more racks are joined in a stacked relationship. The foot loops 18 rest on the transverse wires and as a load is deposited on the carrier the foot loops tend to move outwardly providing a more secure stacking connection.

The foregoing rack construction in a simple form is fabricated from wire material to provide a load supporting surface 10 defined by elongated perimeter or side wires 11 and transversely directed wires 12 including transverse wires adjacent the opposite ends of the elongated side wires. There are vertically directed wire leg members 14 freestanding between a portion connected to the supporting surfaces and extending to foot formations 18 which carry the load placed on the supporting surface. In addition the rack is provided with a wire formation 16 at each opposite end to enable the rack to be moved about. That formation allows the freestanding foot formation 16 so that two or more racks may be engaged in vertical stack positions. The foot formations 18 thereby retain the stack of racks in cooperation with the load supporting surfaces being unobstructed and open to receive a load or allow the removal of a load. Also the leg members 14 are formed to permit the racks to be stacked in nested positions to conserve space because a series of racks can be accommodated in one shipping carton.

In the views of FIGS. 4, 5 and 6, with the racks 10 in stacked positions, the formation of the outwardly turned foot loops 18 have a slight slope from the horizontal due to the fact that the legs 15 are angled inwardly so these foot loops can slide outwardly under the slightly inwardly bent handle loops 16A from the elbows 17. Thus, the ends of the foot loops 18 are able to rest for support on the adjacent transverse perimeter wire 11 (see FIG. 6). The off-horizontal slope of the foot loop 18 is chosen so the stacking function is improved as the load on the upper rack will tend to cause the foot loops 18 to slide outwardly into position on the wire 11. Also, when the upper rack 10A is picked up for moving the racks 10 and 10A bodily without removing the load, the foot loops 18 will move upwardly under the handle loop portions 16A and assume a secure self-locking engagement due to the springy character of the wire which resists inward displacement of the legs 15.

Figure 7:
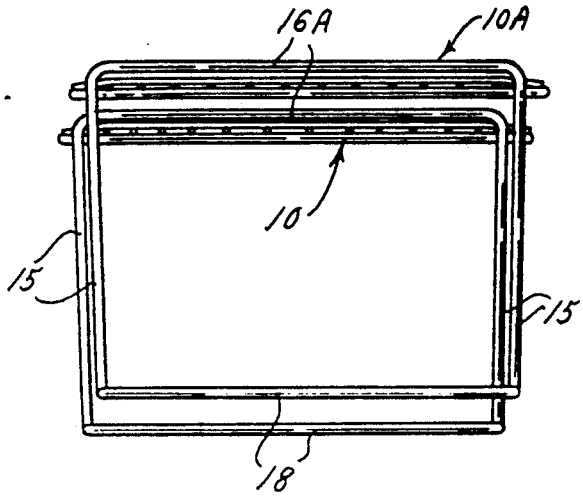
FIG. 7 is an end view of a nested pair of racks of the type seen in FIG. 1.

The racks of FIG. 1 can easily be nested together by fitting the legs 15 of the top rack 10A along side the legs 15 of the bottom rack 10 and then allowing the top rack to move down until the inside surfaces of the elbow 17 engage on the corners of the transverse perimeter wires 11. A nesting of two racks is seen in FIG. 7. The nesting of more than two racks is desired to be able to nest several racks in the same shipping carton, or to allow a store outlet to conserve storage space by nesting many racks in the manner shown. The ability to nest racks is further gained by the tapering formation of legs 15 caused by the handle loop 16A being longer than the length of the foot loops 18 (See FIG. 3). The shaping of the end members 14 with the tapering of the legs 15 in the manner indicated, and the formation of the elbows 17 which spaces the legs members 15 apart a distance greater than the length of the longitudinal perimeter wire 11, allows the racks to nest together with a slight lateral off-set of the end members 14 in the stack of such racks.

The foot loop 18 comprises foot element **18*a*, and a transverse wire 18B. Wire 18B bridges across the elements 18A to fix the legs 15 spaced apart from each other. The foot elements 18A each have a short, terminal portion which lies substantially horizontally to set the rack upon a floor, or platform, or some such bearing surface. Between the aforesaid short, terminal portion and the leg 15 integral therewith, the foot elements 18A each have an arcuately bent portion, the latter so turned as to extend the terminal portion outwardly. In the nesting of the racks (earlier explained) the arcuate bent portions of the foot elements 18A latchingly engage the handle loops 22**.

Figure 9:
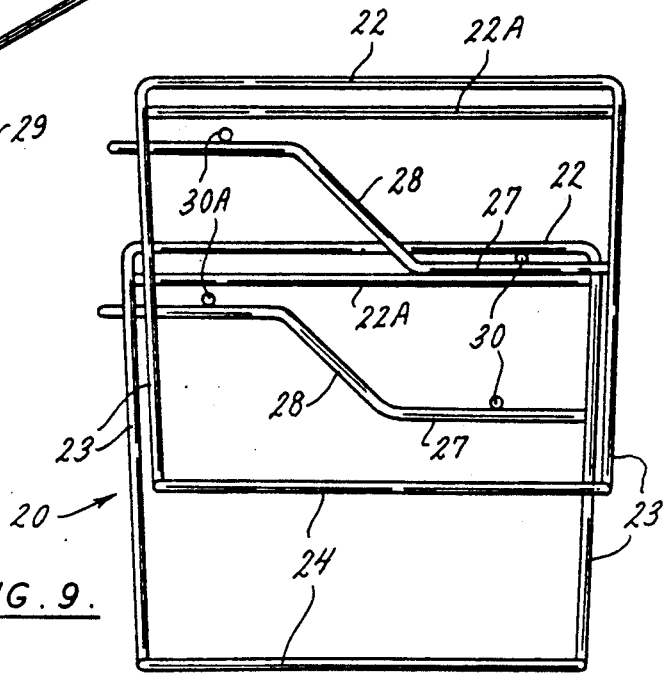
FIG. 9 is an end view of the racks seen in FIG. 8 in nested position.

Turning now to FIGS. 8 and 9, there is shown a modified shelf 20 that is suitable for supporting objects such as shoes of practically all types. The rack 20 can be used as a single rack, or it can be used in stacked relation in the manner seen in FIG. 4. Furthermore, the rack of FIG. 8 can be nested in the same way that the rack of FIG. 1 can be nested as in FIG. 9.

The characteristic of the modified rack 20 is that the leg members 21 are essentially like the leg members 14, in that there is a handle loop 22 ending in depending legs 23 which are tapered toward each other to end in an out-turned foot loop 24. Instead of the rack 20 having a flat shelf surface, it is constructed with an open-work support composed of a U-shaped member 25 (FIG. 8) having as its base a longitudinal wire 26 ending in support branches 27 which are parallel and formed with a stepped portion 28 so that the end 29 are at a lower level than the longitudinal wire 26. The wire 26 is welded to the leg members 21 adjacent the bends which form the branches 27, thus affording proper stability to the leg members 21, along with the welded attachment of the end portions 29 of branches 27 together with the adjacent longitudinal wire 30 which holds the ends 29 in fixed separation and support for the leg members 21. A second support wire 3OA cooperates with wire 30 to stabilize the leg members when flexed for stacking or nesting.

Figure 10:
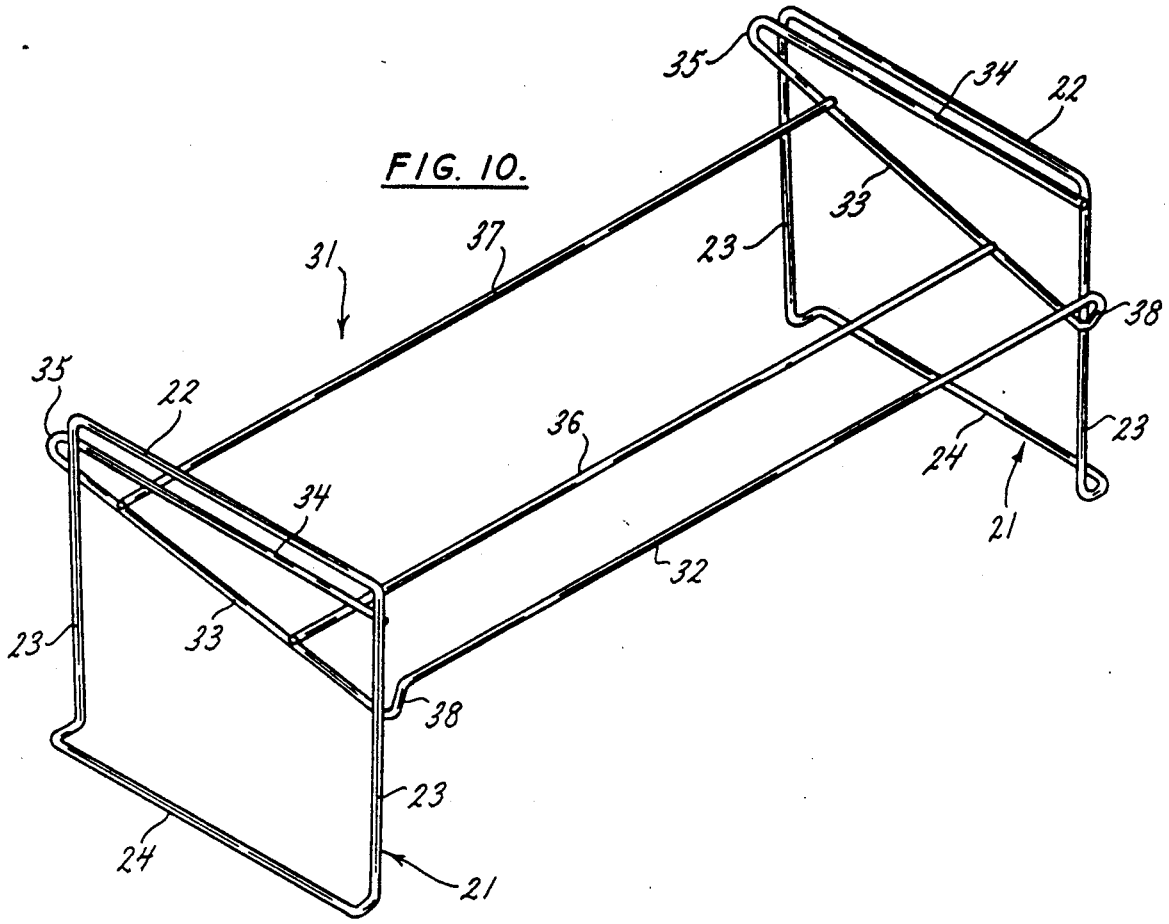
FIG. 10 is a perspective view of a further modified rack with a different support for articles like shoes.

In FIG. 10 there is shown another form of support member 31 which serves a purpose similar to the member 25 in FIG. 9. The member 31 is characterized as a U-shaped wire having a base end wire 32 of a suitable length to position the opposite ends branches 33 for locating leg members 21 in spaced relation. Each of the branch wires 33 are elongated so that an end portion 34 of the length thereof may be reversely directed at the bends 35. Thus, the reversal of the end portions 34 of the branches 33 are positioned to be welded or suitably attached to the respective legs 23 of the leg member 21. Before the member 31 is attached to a pair of leg members 21, longitudinal article support wires 36 and 37 are welded or attached, as shown in FIG. 10, and the wire of base end 32 is turned up at bends 38 so the wire 32 is able to form a stop rest for articles laid across the wires 36 and 37.

Since, the reversely directed wires 34 need to be affixed to the respective leg members 21 below the handle loops 22 and horizontally positioned, the branch wires 33 will assume a slanted position which locates the wire 37 at a higher elevation than wire 36. It is noted that in FIG. 9 there is a horizontal wire 22A.

In FIG. 11 there is shown a modified article support consisting of the perimeter wire 11 (See FIG. 2) attached to the leg member 14. In this modification the wire grid 12 and 13 of FIG. 2 is changed to a perforated sheet 40. This illustrates the adaptability of the rack to a variety of different uses.

The foregoing description has set forth the characteristics of the rack construction so as to distinguish it from basket type devices which prevent ready access from all sides. In this regard, it is particularly to be noted that in each of the aforedescribed embodiments, there is provided a rectangular, load-bearing, wire structure, in an upper portion of the rack, (a) occupying substantially only one, given plane, and (b) formed of fully bounding, peripheral wire. In the FIG. 1 embodiment, such structure is comprised by wire 11. In the FIG. 8 embodiment, such structure is comprised by wires 26, 30A and 28. Finally, in the FIG. 10 embodiment, the subject load-bearing structure is bounded by wires 33, 36 and 37. Each of these rectangular structures, subsisting in substantially one, given plane each, is provided to support articles thereupon. It is also characteristic of the present rack that it can be easily nested, one with another, without using the foot loops 18 as hooks, Thus, a number of racks can be nested together and transported in a bulk type nested assembly. A further characteristic of the present rack is that several racks may be easily stacked, one on top of another, without fear of detachment except while lifting a loaded rack by the purposeful application of pressure to squeeze the leg elements to release the hook engagement.

In view of the foregoing details of description pertaining to the various embodiments it should now be appreciated that the rack has been constructed so that the end leg members are essentially alike in which the horizontal handle and foot components are parallel with the handle being longer than the foot so the vertically directed legs are slightly slanted or angled inwardly forming the leg member into a trapezoidal configuration. The article supporting structure of the rack interconnects the leg members and allows the leg members to be movable toward each other to enable the outwardly angled feet to engage under the handles. The support for the feet may be supplied from the article supporting structure, as in FIGS. 1, 10 or 11, or it may be supplied as an independent component as in FIG. 8.

It is also evident that the article supporting structure may consist of wire means defining the perimeter of a support surface, as seen in FIGS. 2 or 11. Such structure may also be formed from formed wire components, such as U-shaped wires with end branches of suitable shapes, as in FIGS. 8 and 10. In all cases, the racks are configured so that stacking (FIGS. 4 and 5) is easily accomplished. The racks are equally capable of being nested to conserve transportation space or storage space requirements (FIG. 7 and 9).

It is appreciated that the foregoing description may suggest modificaitons of an equivalent nature without departing from the scope of the invention.

What is claimed is:

1. A rack, constructed of wire components, comprising:

first means, in an upper portion of the rack, for supporting articles thereupon, including a load-bearing, wire structure (a) occupying substantially only one, given plane, and (b) formed of fully bounding, peripheral wire;

second means, for setting the rack on a bearing surface such as a floor, or platform, or the like, comprising wire foot elements; and third means, coupled to, and cooperative with, said foot elements, for supporting said first means in elevation, comprising substantially straight, wire, leg members; wherein said leg members are joined, adjacent first ends thereof, to opposite ends of said first means, and are joined at second ends thereof to said foot elements; and fourth means, comprising handles, joined to said opposite ends of said first means, and elevated from said first means; wherein said foot elements include a wire transversely bridging across one of said second and third means for fixing said leg members spaced apart from each other;

said foot elements further comprise means for latchingly engaging one of said first and fourth means of a second rack having substantially the same construction as the aforesaid rack, in order to stack said second rack thereupon; and said latchingly engaging means comprises given, bent portions of said foot elements for receiving, therewithin, one of said first and fourth means of the aforesaid, second rack.

2. A rack, constructed of wire components, comprising:

first means, in an upper portion of the rack, for supporting articles thereupon, including a rectangular, load-bearing, wire structure, (a) occupying substantially only one, given plane, and (b) formed of fully bounding, peripheral wire;

second means, for setting the rack on a bearing surface such as a floor, or platform, or the like, comprising wire foot elements; and third means, coupled to, and cooperative with said foot elements, for supporting said first means in elevation, comprising substantially straight, flexible, wire, leg members; wherein said leg members are joined, adjacent first ends thereof, to opposite ends of said first means, and joined at second ends thereof to said foot elements; and fourth means, comprising handles, joined to said opposite ends of said first means, and elevated from said first means; wherein said foot elements include a wire transversely bridging across one of said second and third means for fixing said leg members spaced apart from each other;

said foot elements further comprise means for latchingly engaging one of said first and fourth means of a second rack having substantially the same construction as the aforesaid rack, in order to stack said second rack thereupon; and said latchingly engaging means comprises arcuately bent portions of said foot elements for receiving, therein, one of said first and fourth means of the aforesaid, second rack upon said flexible leg members, at said opposite ends of said first means, being flexibly displaced, inwardly towards each other, to facilitate engagement of said bent portions of said foot elements with said one of said first and fourth means.

3. A rack, according to claim 1, wherein:

said leg members are angled inwardly toward each other and, consequently, dispose said bent portions of said foot elements closer together than are said first ends of said leg members.

4. A rack, according to claim 1, wherein:

said load-bearing, wire structure occupies a horizontal plane.

5. A rack, according to claim 1, wherein:

said load-bearing, wire structure occupies a plane which is slanted from horizontal.

6. A rack, according to claim 1, wherein:

said load-bearing, wire structure includes, at each end thereof, a wire fixed to leg members thereat at differing elevations of said leg members, in order to support articles on said structure in a slanted disposition.

7. A rack, according to claim 1, wherein:

said load-bearing, wire structure includes, at each end thereof, a wire fixed to said leg members thereat (a) at right angles relative to said leg members, and (b) at differing elevations of said leg members, said latter wire having stepped portions, lying substantially horizontally, occupying differing elevations relative to said leg members.

8. A rack, according to claim 7, further including:

a wire bridging across a lowermost one of said stepped portions.

* * * * *

UNITED STATES PATENT AND TRADEMARK OFFICE

CERTIFICATE OF CORRECTION

PATENT NO. : 5,035,335

DATED : July 30, 1991

INVENTOR(S) : Mohammad Massoudnia and Martin Snider

It is certified that error appears in the above-identified patent and that said Letters Patent is hereby corrected as shown below:

The title page of the copy of the patent omitted the name of Martin Snider, Englewood Cliff, New Jersey as a co-inventor.

Signed and Sealed this

Eighth Day of September, 1992

*Attest:*

DOUGLAS B. COMER

*Attesting Officer*

*Acting Commissioner of Patents and Trademarks*